US006183610B1

(12) United States Patent
Kataoka et al.

(10) Patent No.: US 6,183,610 B1
(45) Date of Patent: Feb. 6, 2001

(54) APPARATUS FOR COMPOSITE PLATING THE INNER SURFACE OF A CYLINDRICAL BODY

(75) Inventors: Yoshiyuki Kataoka; Yasutoshi Ohtou; Masaaki Beppu, all of Tokyo (JP)

(73) Assignee: Nihon Parkerizing Co.,. Ltd., Tokyo (JP)

( * ) Notice: Under 35 U.S.C. 154(b), the term of this patent shall be extended for 0 days.

(21) Appl. No.: 09/074,400

(22) Filed: May 8, 1998

(30) Foreign Application Priority Data

May 9, 1997 (JP) ..... 9-119258

(51) Int. Cl.[7] ..... C25D 3/12
(52) U.S. Cl. ..... 204/272; 204/224 R
(58) Field of Search ..... 204/155–194, 204/225, 228.8, 289, 297.01, 297.07, 625, 626, 224 R; 205/131, 132, 133, 143, 151

(56) References Cited

U.S. PATENT DOCUMENTS 5,295,449 * 3/1994 Maeda ..... 110/229
5,486,272 * 1/1996 Hemsley ..... 204/105 R
5,496,463 * 3/1996 Mori ..... 205/109
5,666,933 * 9/1997 Koriyama ..... 123/668

FOREIGN PATENT DOCUMENTS 52-093636 * 8/1977 (JP) .
55-031006 * 3/1980 (JP) .
55-31006 7/1980 (JP) .
7-157899 6/1995 (JP) .
52-93636 8/1997 (JP) .

* cited by examiner

*Primary Examiner*—Kathryn Gorgos
*Assistant Examiner*—J. Maisano
(74) *Attorney, Agent, or Firm*—Griffin & Szipl, P.C.

(57) ABSTRACT

An apparatus for composite plating the inner surface of a cylindrical body, wherein a rod shaped electrode is inserted in a cylindrical body, composite plating liquid is made to flow upward in the annular space between the rod shaped electrode and the inner surface of the cylindrical body, and electric power is applied between the rod shaped electrode and the cylindrical body to composite plate the inner surface of the cylindrical body, comprises a baffle plate disposed above the cylindrical body to oppose an upward flow of the composite plating liquid out of the annular space.

10 Claims, 3 Drawing Sheets

Fig.2

| flow velocity (cm/sec) | (33) | (43) | (54) | (65) | (76) | (87) | (97) | (106) | (119) | (130) |
|---|---|---|---|---|---|---|---|---|---|---|
| current density 30A/dm$^2$ | △ | | △ | ○ | ○ | ◎ | | | | |
| current density 40A/dm$^2$ | × | | × | × | | ○ | | | | ○ |

appearance of plating layer

× Flaking, blistering were observed. Local lack of plating was observed.

△ Heavy flowering was observed at some edges. Surface was matted throughout.

○ Light flowering was observed at some edges. Light rough deposit was observed.

◎ No flowering was observed at any edge. No rough deposit was observed. Surface was semi-glossy throughout.

APPARATUS FOR COMPOSITE PLATING THE INNER SURFACE OF A CYLINDRICAL BODY

BACKGROUND OF THE INVENTION

The present invention relates to an apparatus for composite plating the inner surface of a cylindrical body such as an engine cylinder, etc.

There have been proposed a plurality of kinds of updraft flow apparatuses for composite plating the inner surface of a cylindrical body, wherein a rod shaped electrode is inserted in the cylindrical body, composite plating liquid, comprising plating liquid containing metallic ions and fine particles of antiabrasion materials, lubricants, etc. dispersed in the plating liquid, is made to flow upward in the annular space between the rod shaped electrode and the inner surface of the cylindrical body, and electric power is applied between the rod shaped electrode and the cylindrical body to composite plate the inner surface of the cylindrical body. An example of a conventional composite plating apparatus is shown in FIG. 3.

In the conventional updraft flow apparatuses for composite plating the inner surface of a cylindrical body, the maximum current density is practically restricted to about 20 $A/dm^2$ because circumferential distribution of the flow velocity of the composite plating liquid in the annular space is uneven and the increase of the current density causes defects in appearance, such as burning, rough deposits, lack of plating, flaking, flowering, etc. Thus, the productivity of the composite plating work with the conventional updraft flow apparatuses for composite plating the inner surface of a cylindrical body is low.

SUMMARY OF THE INVENTION

An object of the present invention is to provide an updraft flow apparatus for composite plating the inner surface of a cylindrical body, wherein a rod shaped electrode is inserted in the cylindrical body, composite plating liquid is made to flow upward in the annular space between the rod shaped electrode and the inner surface of the cylindrical body, and electric power is applied between the rod shaped electrode and the cylindrical body to composite plate the inner surface of the cylindrical body, which apparatus can achieve higher productivity of the composite plating work than conventional apparatuses.

In accordance with the present invention, there is provided an apparatus for composite plating the inner surface of a cylindrical body, wherein a rod shaped electrode is inserted in the cylindrical body, composite plating liquid is made to flow upward in the annular space between the rod shaped electrode and the inner surface of the cylindrical body, and electric power is applied between the rod shaped electrode and the cylindrical body to composite plate the inner surface of the cylindrical body, which apparatus comprises a baffle plate disposed above the cylindrical body to oppose the upward flow of composite plating liquid out of the annular space.

According to a preferred embodiment of the present invention, the apparatus further comprises a rectification cylinder disposed adjacent to the lower end of the cylindrical body and extending coaxially with the cylindrical body over a distance equal to or larger than the outside diameter of the annular space.

According to another preferred embodiment of the present invention, the apparatus further comprises a rectification cylinder disposed adjacent to the upper end of the cylindrical body and extending coaxially with the cylindrical body over a distance equal to or larger than the outside diameter of the annular space.

According to another preferred embodiment of the present invention, the apparatus further comprises a flow rate adjusting tank disposed below the cylindrical body. The flow rate adjusting tank is provided with an opening opposing the lower end of the annular space. In the apparatus, the composite plating liquid is made to flow from the flow rate adjusting tank into the annular space through the opening.

According to another preferred embodiment of the present invention, the flow rate adjusting tank is provided with a plurality of openings. A cylindrical body is set on each opening. In the apparatus, the composite plating liquid is made to flow from the flow rate adjusting tank into each annular space through each opening.

According to another preferred embodiment of the present invention, the apparatus further comprises a jig for fixing the cylindrical body to the apparatus for composite plating. The jig is provided with a composite plating liquid discharging hole which communicates with a port extending from the inner surface to the outside of the cylindrical body.

According to another preferred embodiment of the present invention, the composite plating liquid flowing upward out of the annular space and colliding with the baffle plate is scattered around the cylindrical body from the peripheral portion of the baffle plate. The composite plating liquid flowing down below the cylindrical body is recovered to be returned to the annular space.

According to another preferred embodiment of the present invention, the peripheral portion of the baffle plate is bent downward.

According to another preferred embodiment of the present invention, the apparatus further comprises an anti-splash wall disposed around the cylindrical body.

According to another preferred embodiment of the present invention, the composite plating liquid flowing upward out of the annular space and colliding with the baffle plate is recovered through a closed-circuit pipe without being scattered around the cylindrical body to be returned to the annular space.

Further objects, features and advantages of the present invention will become apparent from the Detailed Description of the Preferred Embodiment when read in conjunction with the accompanying drawings.

BRIEF DESCRIPTION OF THE DRAWINGS

In the drawings:

FIG. 2 is a table rating the observed appearance of composite plating layers produced by an apparatus for composite plating the inner surface of a cylindrical body in accordance with a preferred embodiment of the present invention.

DETAILED DESCRIPTION OF THE PREFERRED EMBODIMENTS

Figure 1:
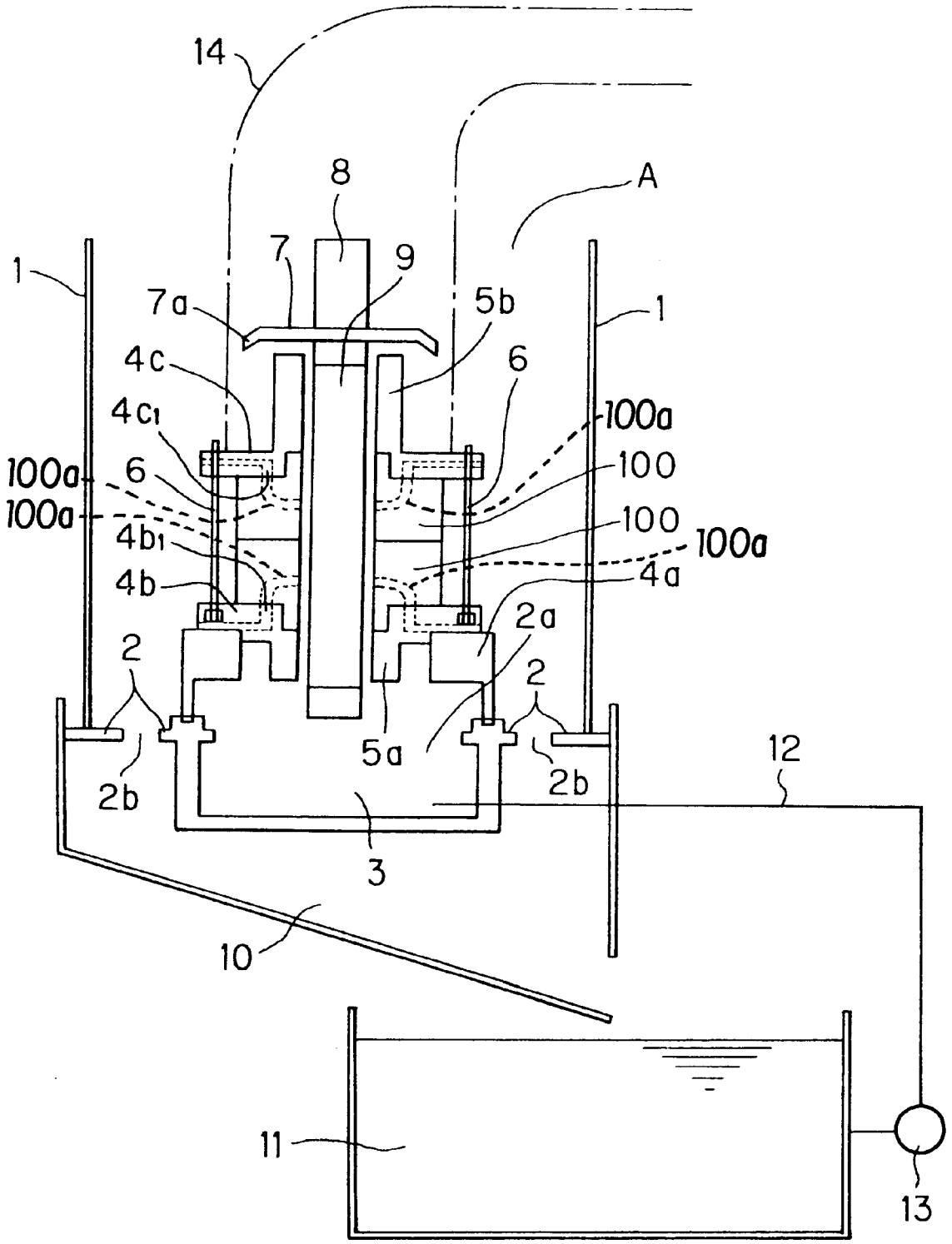
FIG. 1 is a side sectional view of an apparatus for composite plating the inner surface of a cylindrical body in accordance with a preferred embodiment of the present invention.
Figure 3:
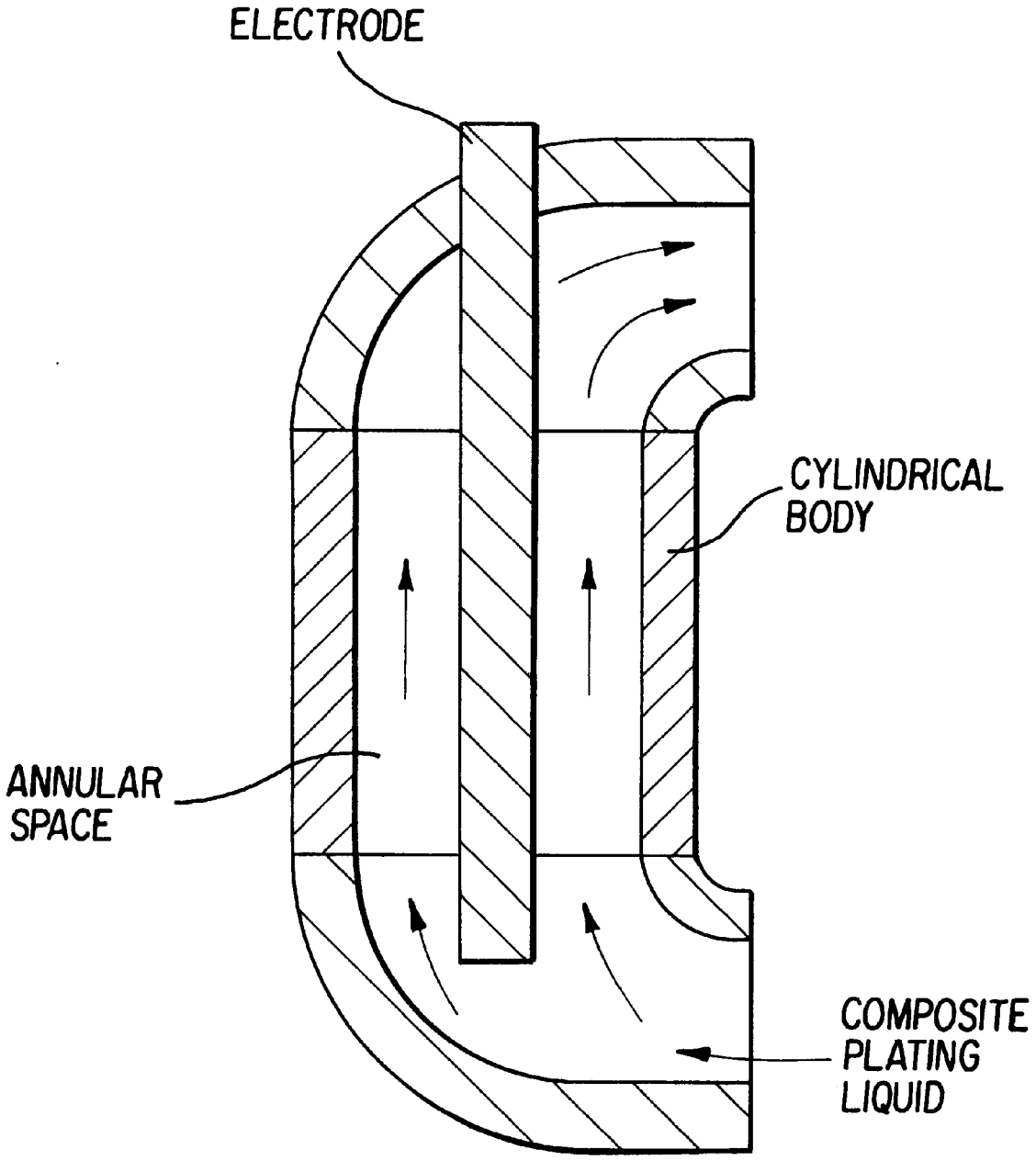
(PRIOR ART) FIG. 3
FIG. 3 is a sectional view of a conventional composite plating apparatus.

As shown in FIG. 1, a portion of a plating factory is enclosed by an anti-splash wall 1 and a floor plate 2 to form a composite plating booth A. A flow rate adjusting tank 3 is disposed below the floor plate 2. The floor plate 2 forms the top plate of the flow rate adjusting tank 3. The portion of the floor plate 2 which forms the top plate of the flow rate adjusting tank 3 is provided with a plurality of circular openings 2*a*.

A plurality sets of works 100 are set on a plurality of openings 2*a* in a manner described hereinafter.

Each opening 2*a* is surrounded by an annular groove made in the floor plate 2. Looking at any one of the openings 2*a*, a cylindrical first work fixing jig 4*a* made of electrical insulating material fits in the annular groove at its lower end. The first work fixing jig 4*a* is detachably fixed to the floor plate 2 with clamps which are not shown in the drawing.

A cylindrical second work fixing jig 4*b* made of electrical insulating material is set on the first work fixing jig 4*a*. The second work fixing jig 4*b* is detachably fixed to the first work fixing jig 4*a* with clamps which are not shown in the drawing. The inner peripheral portion of the second work fixing jig 4*b* extends downward to form a first rectification cylinder 5*a*.

Two cylindrical works 100 to be composite plated are stacked on and coaxial with the second work fixing jig 4*b*.

A cylindrical third work fixing jig 4*c* made of electrical insulating material is set on and coaxial with the upper work 100. The inner peripheral portion of the third work fixing jig 4*c* extends upward to form a second rectification cylinder 5*b*.

A plurality of tie-rods 6 engage the second work fixing jig 4*b* and the third work fixing jig 4*c*. Nuts engaging the tie-rods 6 but not shown in the drawing are tightened to integrate the second work fixing jig 4*b*, the two works 100 which are stacked on each other and the third work fixing jig 4*c* in a unitary body.

The second work fixing jig 4*b* is provided with a composite plating liquid discharging hole $4b_1$ which communicates with a port 100*a* extending from the inner surface to outside of the lower work 100 through the side wall of work 100. The third work fixing jig 4*c* is provided with a composite plating liquid discharging hole $4c_1$ which communicates with a port 100*a* extending from the inner surface to outside of the upper work 100 through the side wall of work 100.

The inside diameters of the first rectification cylinder 5*a* and the second rectification cylinder 5*b* are set equal to the inside diameter of the works 100. The lengths of the first rectification cylinder 5*a* and the second rectification cylinder 5*b* are set equal to or larger than the inside diameter of the works 100.

A disk shaped baffle plate 7 is disposed above and close to the upper end of the second rectification cylinder 5*b*. The peripheral portion 7*a* of the baffle plate 7 is bent slantedly downward.

A rod body 8 made of electrical insulating material and having a circular cross section extends vertically through the baffle plate 7 and coaxial with the works 100. The rod body 8 is supported by the frame of the plating factory through jigs not shown in the drawing at its upper end. The baffle plate 7 is supported by the rod body 8. The rod body 8 is inserted into the second rectification cylinder 5*b*, the works 100 and the first rectification cylinder 5*a*. The lower end portion of the rod body 8 protrudes downward from the lower end of the first rectification cylinder 5*a*. The surface of the portion of the rod body 8 opposing the second rectification cylinder 5*b*, the works 100 and the first rectification cylinder 5*a* is nickel plated to form a rod-shaped soluble positive electrode 9 with a circular cross section.

The floor plate 2 of the composite plating booth A is provided with plating liquid recovery holes 2*b*. A plating liquid recovery chamber 10 having a slanted bottom plate is defined below the floor plate 2 of the composite plating booth A and below the flow rate adjusting tank 3. A plating liquid circulation tank 11 is disposed below the plating liquid recovery chamber 10. A conduit 12 extends from the plating liquid circulation tank 11 to the flow rate adjusting tank 3. A pump 13 is disposed midway of the conduit 12.

The procedure of the composite plating of the works 100 by the present apparatus will be described.

The first work fixing jig 4*a* is set on and fixed to the floor plate 2 around each opening 2*a*. The second work fixing jig 4*b* is set on and fixed to the first work fixing jig 4*a*. Two works 100 are stacked on the second work fixing jig 4*b*. The third work fixing jig 4*c* is set on the upper work 100. The tie-rods 6 are engaged with the second work fixing jig 4*b* and the third work fixing jig 4*c*. The nuts engaging the tie-rods 6 but not shown in the drawing are tightened.

The rod body 8 provided with the baffle plate 7 is inserted downward into the second rectification cylinder 5*b*, the works 100 and the first rectification cylinder 5*a*.

The soluble positive electrode 9 is connected to the positive pole of a DC power source through an electric cable. The works 100 are connected to the negative pole of the DC power source through an electric cable. The DC power source and the electric cables are not shown in the drawing.

The pump 13 is started to force feed the composite plating liquid from the plating liquid circulation tank 11 to the flow rate adjusting tank 3 through the conduit 12.

The composite plating liquid flows out of the flow rate adjusting tank 3, flows upward into the annular space between the soluble positive electrode 9 and the first rectification cylinder 5*a*, and flows upward in the annular space between the soluble positive electrode 9 and the works 100.

Electric power is applied between the soluble positive electrode 9 and the works 100. Fine metal particles deposit from the composite plating liquid containing metallic ions on the inner surface of the works 100. Thus, metal layers are formed on the inner surfaces of the works 100. Fine particles of antiabrasion materials, lubricants, etc. dispersed in the composite plating liquid are confined between the metal particles depositing on the inner surface of the works 100 to be dispersed in the metal layers. Thus, composite plating layers are formed on the inner surfaces of the works 100. Metallic ions are supplied to the composite plating liquid from the soluble positive electrode 9 to replenish the composite plating liquid with the consumed metallic ions.

The composite plating liquid passes through the annular space between the soluble positive electrode 9 and the works 100, flows upward in the annular space between the soluble positive electrode 9 and the second rectification cylinder 5*b*, and flows upward out of the upper end of the annular space between the soluble positive electrode 9 and the second rectification cylinder 5*b*.

The composite plating liquid flowing upward out of the upper end of the annular space between the soluble positive electrode 9 and the second rectification cylinder 5*b* collides with the baffle plate 7, flows radially outwardly along the baffle plate 7, flows radially outwardly and obliquely downwardly along the peripheral portion of the baffle plate 7 bent slantedly downward, and scatters obliquely downwardly from the periphery of the baffle plate 7.

The composite plating liquid flowing in the annular space between the soluble positive electrode 9 and the works 100 leaks through the port 100*a* extending from the inner surface to the outside of the lower work 100 and the composite plating liquid discharging hole 4*b*, formed in the second work fixing jig 4*b*, and through the port 100*a* extending from the inner surface to the outside of the upper work 100 and the composite plating liquid discharging hole 4*c*, formed in the third work fixing jig 4*c*.

The composite plating liquid scattering obliquely downwardly from the periphery of the baffle plate 7 flows down along the outer surface of the work fixing jigs 4*a* to 4*c* and the works 100 onto the floor plate 2 of the composite plating booth A, flows into the composite plating liquid recovery chamber 10 through the composite plating liquid recovery hole 2*a*, flows down along the inclined bottom plate of the composite plating liquid recovery chamber 10, and returns to the composite plating liquid circulation tank 11.

The composite plating procedure is continued for a predetermined time, while the circulation of the composite plating liquid is continued, thereby forming composite plating layers of desired thickness on the inner surfaces of the works 100.

A plurality of sets of works 100 set on a plurality of openings 2*a* are simultaneously supplied with the composite plating liquid to be simultaneously composite plated.

After the continuation of the composite plating procedure for a predetermined time, the rod body 8 is drawn upward out of the third work fixing jig 4*c*, the third work fixing jig 4*c* and the tie-rods 6 are taken away, and the works 100 are detached from the second work fixing jig 4*b*.

Works 100 not yet plated are set on the second work fixing jig 4*b*, the third work fixing jig 4*c* and the tie-rods 6 are attached, and the composite plating procedure is restarted.

In the present apparatus for composite plating the inner surface of a cylindrical body, the composite plating liquid flowing upward out of the annular space between the soluble positive electrode 9 and the second rectification cylinder 5*b* collides with the baffle plate 7. If the circumferential distribution of the flow velocity of the composite plating liquid in the annular space between the soluble positive electrode 9 and the second rectification cylinder 5*b* is uneven, the circumferential distribution of the static pressure of the composite plating liquid generated by the collision of the composite plating liquid flowing upward out of the annular space with the baffle plate 7 becomes uneven. That is, large static pressure is generated in the circumferential portion where the flow velocity is large, while small static pressure is generated in the circumferential portion where the flow velocity is small. Thus, the flow resistance increases in the circumferential portion where the flow velocity is large to decrease the flow velocity, while flow resistance decreases in the circumferential portion where the flow velocity is small to increase the flow velocity. Thus, the circumferential distribution of the flow velocity of the composite plating liquid in the annular space between the soluble positive electrode 9 and the second rectification cylinder 5*b* is evened, and the circumferential distribution of the flow velocity of the composite plating liquid in the annular space between the soluble positive electrode 9 and the inner surface of the works 100 is evened.

In the present apparatus for composite plating the inner surface of a cylindrical body, no appearance defect is caused by an increase of the current density beyond the maximum allowable current density in the conventional apparatuses because the circumferential distribution of the flow velocity of the composite plating liquid in the annular space between the soluble positive electrode 9 and the inner surface of the works 100 is even. Thus, the present apparatus for composite plating the inner surface of a cylindrical body can achieve higher productivity of the composite plating work than conventional updraft flow apparatuses for composite plating the inner surface of a cylindrical body.

In the present apparatus for composite plating, the inner surface of a cylindrical body, the first rectification cylinder 5*a* and the second rectification cylinder 5*b* are disposed to provide the annular space between the soluble positive electrode 9 and the works 100 with the same annular spaces at its entrance and at its exit, thereby restricting abrupt change of the shape of the flow channel at the entrance and the exit of the annular space between the soluble positive electrode 9 and the works 100. Thus, the flow of the composite plating liquid in the annular space between the soluble positive electrode 9 and the works 100 is stabilized and the generation of turbulence in the flow of the composite plating liquid is suppressed. Thus, the circumferential distribution of the flow velocity of the composite plating liquid in the annular space between the soluble positive electrode 9 and the works 100 is evened, current density can be increased beyond the maximum allowable current density in the conventional apparatuses, and the productivity of the composite plating work is increased.

The lengths of the first rectification cylinder 5*a* and the second rectification cylinder 5*b* are desirably equal to or larger than the outside diameter of the annular space between the soluble positive electrode 9 and the inner surface of the works 100 to sufficiently stabilize the flow of the composite plating liquid.

In the present apparatus for composite plating the inner surface of a cylindrical body, the flow rate adjusting tank 3 is disposed below the works 100, the flow rate adjusting tank 3 is provided with the opening 2*a* opposing the lower end of the annular space between the soluble positive electrode 9 and the inner surface of the works 100, and the composite plating liquid is made to flow from the flow rate adjusting tank 3 into the annular space through the opening 2*a*. The composite plating liquid force fed by the pump 13 does not directly flow into the annular space from the conduit 12 but first flows into the flow rate adjusting tank 3 to be made free from drift current in the flow rate adjusting tank 3, then flows into the annular space. Thus, the flow of the composite plating liquid in the annular space between the soluble positive electrode 9 and the inner surface of the works 100 is stabilized and the generation of turbulence in the flow of the composite plating liquid is suppressed. Thus, the circumferential distribution of the flow velocity of the composite plating liquid in the annular space between the soluble positive electrode 9 and the inner surface of the works 100 is evened, current density can be increased beyond the maximum allowable current density in the conventional apparatuses, and the productivity of the composite plating work is increased.

In the present apparatus for composite plating the inner surface of a cylindrical body, the composite plating liquid is supplied to a plurality sets of the works 100 from the single flow rate adjusting tank 3 to composite plate the plurality sets of the works 100 simultaneously. Thus, the productivity of the composite plating work is increased.

In the present apparatus for composite plating the inner surface of a cylindrical body, the composite plating liquid flowing in the annular space between the soluble positive electrode 9 and the works 100 can leak through the ports

100*a* extending from the inner surface to the outside of the works 100 and the composite plating liquid discharging holes $4b_1$, $4c_1$ formed in the second work fixing jig 4*b* and the third work fixing jig 4*c*. Thus, detergent, pre-treatment liquid, etc. remaining in the ports 100*a* are discharged from the ports 100*a* with the leaking composite plating liquid. Thus, detergent, pre-treatment liquid, etc. remaining in the ports 100*a* do not mix with the composite plating liquid flowing in the annular space between the soluble positive electrode 9 and the works 100 to pollute it.

In the present apparatus for composite plating the inner surface of a cylindrical body, the composite plating liquid colliding with the baffle plate 7 scatters into the space around the works 100 from the periphery of the baffle plate 7. Thus, the setting procedure of the works 100 on the apparatus for composite plating becomes easier than that in the case where the composite plating liquid colliding with the baffle plate 7 is recovered through a closed-circuit pipe and returned to the annular space between the soluble positive electrode 9 and the inner surface of the works 100. Thus, the productivity of the composite plating work is increased.

In the present apparatus for composite plating the inner surface of a cylindrical body, the peripheral portion of the baffle plate 7 is bent downward to scatter the composite plating liquid colliding with the baffle plate 7 obliquely downwardly from the periphery of the baffle plate 7. Thus, the composite plating liquid is kept from scattering far away radially outwardly.

In the present apparatus for composite plating the inner surface of a cylindrical body, the anti-splash wall 1 is disposed around the works 100 to define the composite plating booth A. Thus, the composite plating liquid is kept from scattering far away and contaminating the factory work environment, and the recovery of the composite plating liquid is increased.

The inner surface of a two cycle engine was composite plated by an apparatus for composite plating in accordance with the present embodiment.

The specifications of the apparatus for composite plating and the conditions of the composite plating work were as follows.

Inside diameter of the work: 59 mm

Outside diameter of the soluble positive electrode

| Composition of the composite plating liquid | |
|---|---|
| Nickel sulfamate(60 weight % aqueous solution) | 790 g/l |
| Nickel chloride(6 hydrate) | 15 g/l |
| Boric acid | 45 g/l |
| Sodium saccharin | 5 g/l |
| Hypophosphorous acid(50 weight % aqueous solution) | 0.6 g/l |
| SiC particle(mean diameter: 2.5 $\mu$m) | 100 g/l |
| pH | 3.5 to 4.5 |
| Plating liquid temperature | 55 to 60° C. |
| Duration time of the plating work | 30 minutes |

The appearance of the composite plating layers obtained by the composite plating work was observed. The results of the observation are shown in FIG. 2.

As is clear from FIG. 2, in the apparatus for composite plating in accordance with the present embodiment, a high quality composite plating layer is obtained even if the current density is increased to 30 A/dm$^2$ or 40 A/dm$^2$.

As indicated by the dashed line in FIG. 1, the composite plating liquid colliding with the baffle plate 7 may be recovered to the plating liquid circulation tank 11 through a closed-circuit pipe 14 and returned to the annular space between the soluble positive electrode 9 and the inner surfaces of the works 100. Thus, the environmental contamination can be prevented and the recovery of the composite plating liquid can be increased.

The soluble positive electrode 9 may be replaced with an insoluble positive electrode.

The inner diameter of the first rectification cylinder 5*a* and the second rectification cylinder 5*a* may be made a little larger than the outer diameter of the annular space between the soluble positive electrode 9 and the inner surface of the works 100.

While the present invention has been described with reference to a preferred embodiment, one of ordinary skill in the art will recognize that modifications and improvements may be made while remaining within the spirit and scope of the present invention. The scope of the invention is determined solely by the appended claims.

What is claimed is:

1. An apparatus for composite plating the inner surface of a cylindrical body, comprising a rod shaped electrode insertable in the cylindrical body to define an annular space between the rod shaped electrode and the inner surface of the cylindrical body, a pump arranged so that composite plating liquid is made to flow upward in the annular space between the rod shaped electrode and the inner surface of the cylindrical body, wherein the rod shaped electrode is arranged so that electric power is applied between the rod shaped electrode and the cylindrical body to composite plate the inner surface of the cylindrical body, and further comprising a baffle plate disposed above the cylindrical body to oppose an upward flow of the composite plating liquid out of the annular space.

2. An apparatus of claim 1, further comprising a rectification cylinder disposed adjacent to the lower end of the cylindrical body and extending coaxially with the cylindrical body over a distance equal to or larger than the outside diameter of the annular space.

3. An apparatus of claim 1, further comprising a rectification cylinder disposed adjacent to the upper end of the cylindrical body and extending coaxially with the cylindrical body over a distance equal to or larger than the outside diameter of the annular space.

4. An apparatus of claim 1, further comprising a flow rate adjusting tank disposed below the cylindrical body, the flow rate adjusting tank being provided with an opening opposing the lower end of the annular space, wherein the composite plating liquid is made to flow from the flow rate adjusting tank into the annular space through the opening.

5. An apparatus of claim 4, wherein the flow rate adjusting tank is provided with a plurality of openings, a cylindrical body and a rod shaped electrode inserted in the cylindrical body are set on each opening, and the composite plating liquid is made to flow from the flow rate adjusting tank into each annular space through each opening.

6. An apparatus of claim 1, further comprising a jig for fixing the cylindrical body to the apparatus for composite plating, wherein the jig is provided with a composite plating liquid discharging hole which communicates with a port extending from the inner surface to the outside of the cylindrical body.

7. An apparatus of claim 1, wherein the composite plating liquid flowing upward out of the annular space and colliding with the baffle plate is scattered around the cylindrical body from the peripheral portion of the baffle plate and the composite plating liquid flowing down below the cylindrical body is recovered to be returned to the annular space.

8. An apparatus of claim 7, wherein the peripheral portion of the baffle plate is bent downward.

9. An apparatus of claim 7, further comprising an anti-splash wall disposed around the cylindrical body.

10. An apparatus of claim 1, wherein the composite plating liquid flowing upward out of the annular space and colliding with the baffle plate is recovered through a closed-circuit pipe without being scattered around the cylindrical body to be returned to the annular space.

* * * * *